US006688943B2

(12) United States Patent
Nagaoka

(10) Patent No.: US 6,688,943 B2
(45) Date of Patent: Feb. 10, 2004

(54) GIRDLE

(75) Inventor: Nobuo Nagaoka, Hikone (JP)

(73) Assignee: Aman Life Co., Ltd., Shiga-ken (JP)

( * ) Notice: Subject to any disclaimer, the term of this patent is extended or adjusted under 35 U.S.C. 154(b) by 0 days.

(21) Appl. No.: 10/075,250

(22) Filed: Feb. 15, 2002

(65) Prior Publication Data

US 2002/0115378 A1 Aug. 22, 2002

(30) Foreign Application Priority Data

Feb. 16, 2001 (JP) ..... 2001-040140

(51) Int. Cl.[7] ..... A41C 1/00
(52) U.S. Cl. ..... 450/94; 450/100
(58) Field of Search ..... 450/94–96, 100–106, 450/116, 119, 120, 122, 128, 131–137, 142, 155, 1, 2, 7–13, 17, 19–21; 2/400, 403, 406, 408, 45, 46, 94, 228, 238, 114, 80; 128/96.1, 98.1, 99.1, 100.1, 101.1, 875, 876, 883; 602/23, 67

(56) References Cited

U.S. PATENT DOCUMENTS 825,561 A * 7/1906 Storm ..... 450/155
966,863 A * 9/1910 Saemann ..... 450/155
1,202,668 A * 10/1916 Byrd ..... 450/155
1,426,740 A * 8/1922 Hulick ..... 450/155
1,488,773 A * 4/1924 Anchorstar ..... 450/100
1,599,638 A * 9/1926 Buchanan ..... 450/100
1,711,172 A * 4/1929 Longfellow ..... 450/161
2,300,153 A * 10/1942 Herbener ..... 450/96
2,531,757 A * 11/1950 Whinery ..... 128/875
3,524,449 A * 8/1970 Peters ..... 128/875
4,709,692 A * 12/1987 Kirschenberg et al. ..... 450/94

* cited by examiner

*Primary Examiner*—Gloria M. Hale
(74) *Attorney, Agent, or Firm*—Wenderoth, Lind & Ponack, L.L.P.

(57) ABSTRACT

A girdle is adjustable to fit a figure of a wearer, and is able to adjust a part to be tightened to an extent of the wearer's desired level. The girdle comprises front sides, a back side, and leg encircling regions, but no crotch region. The front sides, the back side and the leg encircling regions are formed from one piece, and the front sides and the leg encircling regions, respectively, are openable/closable. Fastening members, which can be fastened and unfastened, are disposed respectively on a opening/closing portion of the front sides and the leg encircling regions.

19 Claims, 8 Drawing Sheets

GIRDLE

CROSS REFERENCE TO RELATED APPLICATIONS

The subject application is related to subject matter disclosed in Japanese Patent Application No. 2001-040140 filed on Feb. 16, 2001 in Japan to which the subject application claims priority under Paris Convention and which is incorporated herein by reference.

BACKGROUND OF THE INVENTION

1. Field of the Invention

The present invention relates to a novel undergarment, more specifically, a unisex girdle which is easily put on, adjustable to fit a wearer's figure and able to adjust a part to be tightened to the wearer's desired level.

2. Related Background Art

A girdle or other clothing have been worn as clothes having a figure-correcting function. This clothing is constructed from elastic fabrics in order to bring out the figure-correcting function. Thus, a wearer corrects his/her figure by compressing each part of his/her body by wearing a figure-correcting girdle or other undergarment. Also, to accomplish an effective figure correction, products which further comprise materials such as a reinforced cloth, and the like, having strong elasticity intensively at a specific part, are sold on the market.

However, sizes of marketed girdles are limited to a few kinds, such as S, M, L, LL, and the like, in spite of the fact that each wearer has a different figure. In actuality, in manufacturing, a length around the waist, hips, lower abdomen and groin, above the crotch, and the like are specified for each marketed size, and a shape is formed corresponding to a pattern arranged by a standard size, and then the strength of elasticity is adjusted.

A wearer has no choice other than choosing his/her size of undergarment that is comparatively close to the size of his/her actual figure from among limited groups of a few kinds, unless he/she has an undergarment custom-made to be designed to fit his/her figure. However, the figure of each wearer hardly completely fits one of standard figures of a few limited variations of sizes. For example, a size of a haunch might not fit even if the size of a lower abdomen fits. In this way, when a girdle with a correct size for a certain part is chosen, length of other parts is unlikely to be correct. When compression to only a certain part becomes excessive, a wearer feels uncomfortable and develops mental stress. Also, excessive compression causes possible symptoms such as a raised blood pressure, temperature control malfunction, cold hands/feet, stiff shoulders, insomnia, and the like by obstructing blood circulation to a compressed part. Further excessive compression can be a cause of disfigure of internal organs.

With regard to the above-described, Japanese Patent Laid-Open Publication No. 195105/1997 discloses a girdle for a purpose of achieving a figure-correcting effect which can be controlled in a wide range to fit an individual figure and meet other demands. This girdle comprises an elastic strip sewn up at its center to an inside surface of a back side of a girdle body. A wearer can adjust a compression level of the girdle by pulling both ends of the elastic strip with his/her desired strength and fixing the strip on an elastic cloth sewn on an inside surface of a front side of the girdle body, and thus a figure-correcting effect is achieved regardless of figures or demands. However, this girdle cannot always match sizes of all parts of a wearer, e.g., a size of an abdominal region, and the like, because a size of the girdle body is standardized. Moreover, this girdle cannot be permanently worn if a size of each part is changed, by gaining or losing weight, relative to a size of each part measured at a time when the girdle was chosen to be worn.

Furthermore, a shape of a conventional girdle having a crotch region exhibits a problem such as tightness, sweatiness and insanitation at the crotch caused by air-tightness, and the like. Also, a most disadvantageous point is that it is rather difficult to perform a function of excretion, unless the girdle is completely slid down to a position under the knees, or taken off.

On the other hand, a medical corset is proposed, which can be encircled around hips and thigh parts and then fixed with a wearer's desired pressure (Japanese Patent Laid-Open Publication Nos. 135856/1997 and 137276/1998).

According to this proposal, the corset can be fixed around the hips and the thigh parts with a wearer's desired pressure while causing no trouble at the crotch of a wearer, such as tightness, sweatiness, and the like, due to absence of a crotch region.

However, this medical corset is formed simply by a supporter encircling the hips, and a supporter encircling the thigh parts, being joined together. Specifically, this medical corset is a wearing apparel comprising a supporter encircling the hips and a supporter encircling the thigh parts joined together at a haunch part when the corset is disposed about a wearer. A wearing apparel like this can be used as a medical corset, but not as an undergarment since a crotch part of the wearer is not covered.

SUMMARY OF THE INVENTION

One purpose of the present invention is to overcome the above-described conventional technical problems and to provide a comfortable girdle in which a size of the girdle can be freely adjusted to fit a wearer's figure.

Moreover, another purpose of the present invention is to provide a girdle in which the size of the girdle can be freely adjusted to fit a wearer's figure, and appearance of the girdle is not different from a regular undergarment when the girdle is disposed about the wearer.

Furthermore, another purpose of the present invention is to provide a girdle that has neither tightness nor air-tightness at a wearer's crotch part.

The girdle according to the present invention comprises front sides, a back side, and leg encircling regions, but no crotch region. The front sides, the back side and the leg encircling regions are formed from one piece, and the front sides and the leg encircling regions, respectively, are openable/closable.

Moreover, the girdle according to the present invention comprises a hips encircling region which encircles hips of a wearer, and leg encircling regions which encircle legs of the wearer. The hips encircling region and the leg encircling regions are formed integral and continuous from a single cloth. The hips encircling region of the single cloth includes on front sides thereof fastening members which can be fastened and unfastened. The hips encircling region encircles the hips of the wearer, while portions thereof overlap each other at an abdominal region of the wearer, and these portions are secured adjustably by the fastening members. The leg encircling regions of the single cloth each include at least one projected end portion having a fastening member which can be fastened and unfastened. The leg encircling regions encircle the legs of the wearer, with the projected end portions adjustably securing the leg encircling regions of the girdle, which are respectively positioned under the projected end portions, by the fastening members.

Regarding the girdle according to the present invention, a wearer can freely control a correction pressure via fastening parts formed respectively on opening/closing regions/portions of the front sides and the leg encircling regions. Also, it is not necessary to pass legs through a tubular parts of a girdle body since the girdle according to the present invention has no crotch part or region. The girdle becomes one-piece of cloth when the opening/closing portions of the girdle are unfolded, so the girdle can be put on the body of the wearer by encircling the body of the wearer with the cloth. Also, while wearing the girdle, the wearer feels comfortable since a crotch part of the wearer has neither pressure nor unsanitary sweatiness. Moreover, excretion is possible without taking off the girdle if the wearer only opens the opening/closing portions of the leg encircling regions.

Regarding the girdle according to the present invention, when the girdle is worn end portions are connected so as to form the leg encircling regions of the girdle, and an opening formed at a crotch part of the wearer is hidden by a portion of the leg encircling regions being pulled into an area between legs of the wearer.

In this case, the crotch part of the wearer can be hidden from others' regular sight in a normal situation while wearing the girdle. Thus, the girdle can be provided with a preferable appearance which is not different from a normal undergarment.

DETAILED DESCRIPTION OF THE PREFERRED EMBODIMENTS

A first embodiment of a girdle according to the present invention will be described in detail with reference to the attached drawings.

The girdle in accordance with the first embodiment is a girdle which encircles hips and leg parts of a wearer and forms a one-piece cloth when the girdle is developed. In the following explanation of this embodiment, thigh parts are exemplified as leg parts.

Figure 1:
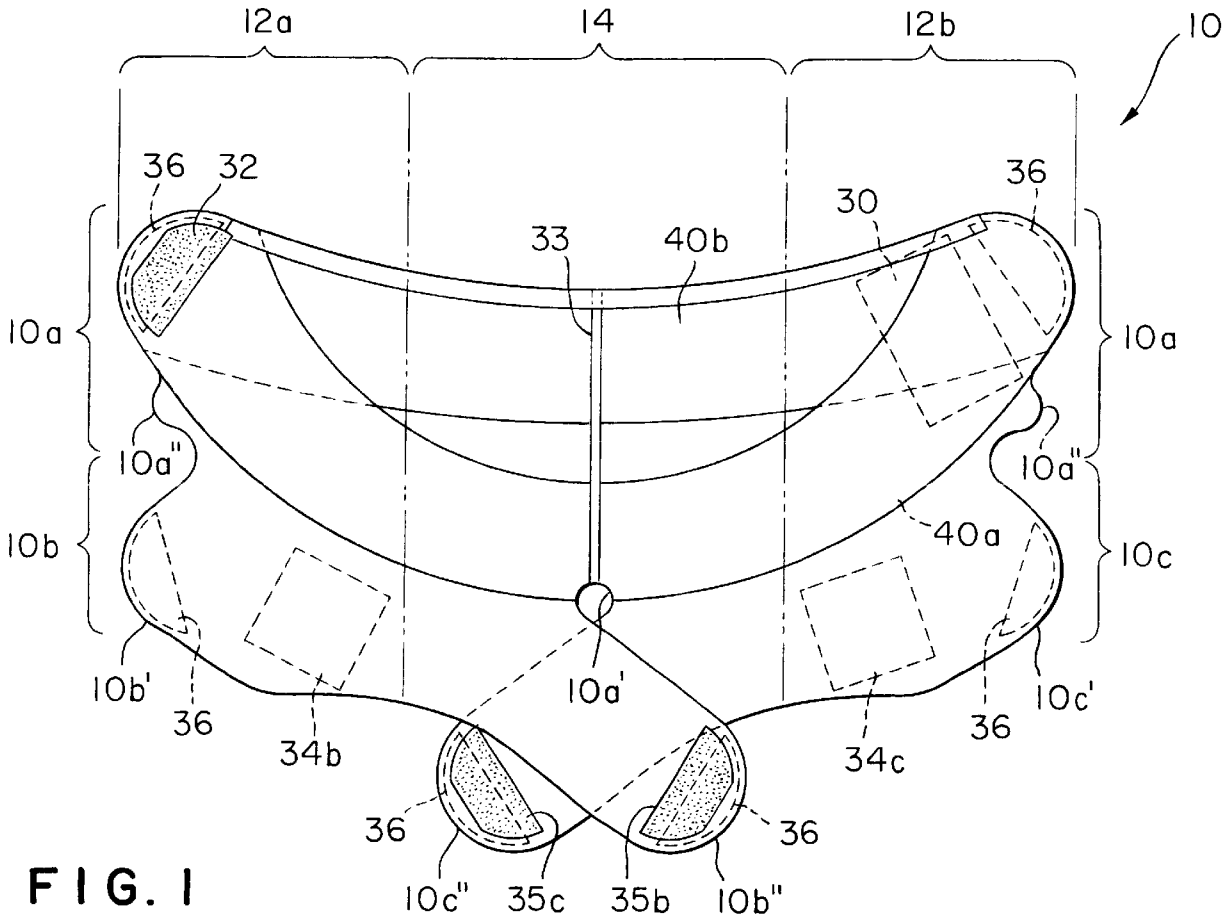
FIG. 1 is a development of a girdle according to a first embodiment of the present invention showing a surface facing a body of a wearer.
Figure 2:
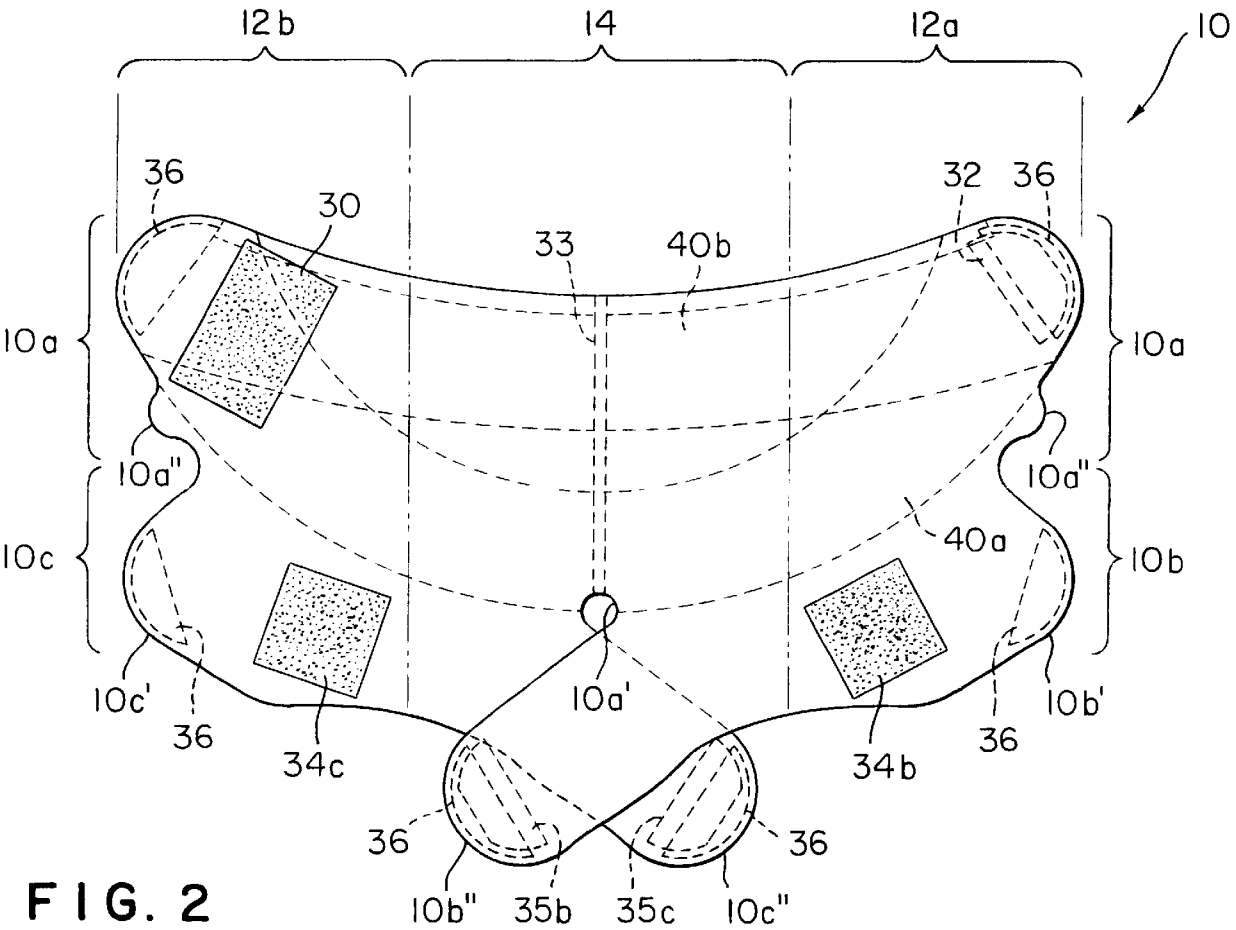
FIG. 2 is a development of the girdle according to the first embodiment of the present invention showing a surface facing clothes of the wearer.

FIG. 1 shows a surface of the girdle according to the present embodiment being laid out flat and facing a body of a wearer. FIG. 2 shows a surface of the girdle according to the present embodiment also being laid out flat but facing clothes of the wearer.

As shown in FIGS. 1 and 2, the girdle, referred to as 10 according to the present embodiment, comprises a hips encircling region 10*a* which is placed to encircle hips of the wearer, and leg encircling regions 10*b* and 10*c* which encircle the wearer's right thigh and left thigh respectively. The hips encircling region 10*a* comprises end portions (first portion and second portion) which are narrow in width and a central part which is wider than the end portions in order to wrap hips of a human body along their curves. A lower edge of the hips encircling region 10*a* reaches uninterruptedly for almost its full length an upper edge of the leg encircling regions 10*b* and 10*c*, and is preferably formed into one piece without a boundary line. At a center of the lower edge of the hips encircling region 10*a*, a central part 10*a*' is formed which makes no contact with either the leg encircling region 10*b* or 10*c*, and is pulled into an area between legs of the wearer when the girdle is worn.

Reference character 14 shows a back side of the girdle covering a part from a back side to both left and right sides of hips of a wearer when the girdle is worn, and reference character 12*a* shows a right front side of the girdle covering a part from the right side of the hips to a front side of a lower abdomen of the wearer when the girdle is worn, and reference character 12*b* shows a left front side of the girdle covering a part from the left side of the hips to the front side of the lower abdomen of the wearer when the girdle is worn. The back side 14, the right front side 12*a* and the left front side 12*b* construct the hips encircling region 10*a* in its entirety.

The girdle according to the present invention at least comprises the front sides 12*a* and 12*b*, the back side 14 and the leg encircling regions 10*b* and 10*c*, wherein the front sides 12*a* and 12*b*, the back side 14 and the leg encircling regions 10*b* and 10*c* are formed from one piece. In FIG. 1, projections 10*a*", illustrated at portions where both of left and right side ends of the hips encircling region 10*a* and the leg encircling regions 10*b* and 10*c* are joined, show waves of cloth which are made to have extra allowances in these portions and which extend and provide a custom fit on the body of the wearer when the girdle is worn.

Reference character 40*a* indicates a first correction cloth. A central part of the first correction cloth 40*a* is positioned at a bottom edge of the hips encircling region 10*a*, and both ends of the first correction cloth 40*a* define an arc upwardly and reach both ends of the hips encircling region 10*a*. This correction cloth 40*a* pulls up a part under a haunch bulge of the back side 14 and tightens the abdominal region of the wearer by providing a tension from side parts. Thus, the wearer can achieve an effective haunch lifting.

Reference character 40*b* indicates a second correction cloth. The second correction cloth 40*b* extends along an upper edge of hips encircling region 10*a* with both its ends overlapping on sides of the first correction cloth 40*a*, respectively, and effectively tightens a waist region and abdominal region by a tension applied when the girdle is worn.

Besides positions in the above-described embodiment, a correction cloth for producing a tension can be disposed at any other positions of the front sides, the back side and the thigh parts of the girdle according to the present invention.

Cloths for correction cloths having a tension and an effect of separately correcting individual parts of a body of a wearer include the same material as a girdle body with elasticity, and textiles or fabrics made of fibers containing rubber or spandex.

End portions of the hips encircling region 10*a* meet in front of the lower abdominal region of a wearer, overlapping each other. On both or only one of the end portions of the hips encircling region 10*a*, fastening members 30 and 32 are disposed. Since the right front side 12*a* is formed to be placed on top of the left front side 12*b* in the present embodiment, the fastening member 32 is disposed on a surface of the right front side 12*a*, with the surface facing the body of the wearer, and the fastening member 30 is disposed on a surface of the left front side 12*b*, with this surface facing clothes of the wearer. Obviously, the girdle can be changed so as to have a structure in which the left front side 12*b* is formed to be placed on top of the right front side 12*a*, and in that case, fastening member 30 is disposed on a surface of the right front side 12*a* which faces clothes of a wearer, and fastening member 32 is disposed on a surface of the left front side 12*b* which faces the body of the wearer.

The fastening members 30 and 32 function as one set of attaching members and can be any materials as long as the material is adjustable for correction when attached and detached. However, the material of fastening members 32 and 30 needs to be able to control tension or relaxation, and a fixed position after fastening must be held unless the wearer detaches the members. Materials that meet these qualifications include a hook, a snap, a button, a surface fastener, and the like, for instance. The fastening members can be a combination of these items. In a case that a material which functions as a female member of a surface fastener is used for the girdle body, fastening member 30 is not always necessary. In order to enable the fastening members to control tension or relaxation, it is preferable that the fastening members have a wide enough area for a wearer to have more choices in adjusting an overlapping area of the fastening members so that movements of the body of the wearer are not disturbed.

Regarding the present specification, "opening/closing" is defined as a movement by which a cloth is developed, or fixed, encircling a body by fastening and unfastening fastening members, "an opening/closing surface" is defined as a surface that is a part of a girdle which is opened and closed, and "an opening/closing portion" is defined as a region that is fastened and unfastened, e.g., a surface on which the fastening members overlap each other.

In a case that hooks, snaps or buttons are used as fastening members, a plurality of sets of female parts of each material is disposed on an end portion of the hips encircling region 10*a*, which is fixed under another end, i.e., the left front side 12*b* in the present embodiment, so that a level of tension for correction can be controlled by a choice of the female parts.

In a case that surface fasteners are used as fastening members, fastening and unfastening are easily performed by disposing a male member of a surface fastener on the right front side 12*a*, and a female member of the surface fastener on the left front side 12*b*, according to the present embodiment. It is preferable that the male member of the surface fastener occupies enough area to be adhered to the female member and maintain strength so as not to be detached even by movements of a wearer after putting on the girdle according to the present invention. It is also preferable that an area occupied by the male member of the surface fastener is large enough to improve fit of a wearer's figure and provide an allowance for correction adjustment. It is further preferable that the areas of the male member of the surface fastener and the female member of the surface fastener are adequate enough not to affect appearance of clothes worn over the girdle of the present invention, and not to disturb movements of a wearer.

The male member of the surface fastener and the female member of the surface fastener can be attached by any manner known to a person skilled in the art, including bonding, sewing, thermocompression, and the like.

The girdle can be made of a material which functions as a female member of a surface fastener, instead of disposing a female member of a surface fastener. Materials that can be used as the female member of the surface fastener include a French pile, and the like, and fastening member 30 can be omitted in such a case.

It is preferable that a haunch lifting tape 33 is disposed along a line from the central part 10*a*', positioned at a central part of the lower edge of the hips encircling region 10*a*, to a central part of the upper edge of the hips encircling region 10*a*. The haunch lighting tape 33 is effective in use to lift up a wearer's haunch.

The right leg encircling region 10*b* is contiguous uninterruptedly with the right front side 12*a* of the hips encircling region 10*a* and a part of the back side 14 without borders, and comprises: a front end portion 10*b*' (third portion) which encircles a wearer's right thigh through a front side to an inside of the wearer's right thigh; and a back end portion 10*b*" (fourth portion) which encircles the wearer's right thigh from a backside, passing through the inside to the front side, to an outside of the wearer's right thigh. In the same way, the left leg encircling region 10*c* is contiguous uninterruptedly with the left front side 12*b* of the hips encircling region 10*a* and a part of the back side 14 without borders, and comprises: a front end portion 10*c*' (fifth portion) which encircles the wearer's left thigh through a front side to an inside of the wearer's left thigh; and a back end portion 10*c*" (sixth portion) which encircles the wearer's left thigh from a backside, passing through the inside and the front side, to an outside of the wearer's left thigh.

A fastening member 35*b* is disposed on a surface of the back end portion 10*b*" of the right leg encircling region 10*b*, with the surface facing the body of the wearer, and a fastening member 34*b* is disposed on a surface of a part of the leg encircling region 10*b*, with this surface facing clothes of the wearer and a part of the leg encircling region 10*b* overlapping the fastening member 35*b* when the girdle is worn.

The above-described exemplifies a case in which the back end portion 10*b*" is fixed on top, but otherwise, the front end portion 10*b*' can be fixed on top by disposing a fastening member on the front end portion 10*b*' of the right leg encircling region 10*b*, and disposing another fastening portion at a corresponding part.

In a case that a surface fastener is used as a fastening member, a female member can be omitted by making the girdle from a material which functions as a female member of a fastening member, such as a French pile.

A fastening member 35*c* is disposed on a surface of the back end portion 10*c*" of the left leg encircling region 10*c*, with the surface facing the body of the wearer, and a fastening member 34*c* is disposed on a surface of a part of the leg encircling region 10*c*, with this surface facing clothes of the wearer, and a part of the leg encircling region 10*c* overlapping the fastening member 35*c*, when the girdle is worn. The surfaces on which the fastening members 34*c* and 35*c* are disposed can be reversed for the right leg encircling region 10*b*. Likewise, the female member of the surface fastener can be omitted for the right leg encircling region 10*b*.

Additionally, it is preferable that the left and the right leg encircling regions, and the fastening members thereon, are symmetrically formed in order to be balanced.

Preferably, reinforcing members 36 are attached to both end portions of the hips encircling region 10*a* and both end portions of each the leg encircling region 10*b* and 10*c*. It is favorable in view of a reinforcing effect that the reinforcing members 36 are attached especially to backside surfaces of the male members of the surface fasteners, i.e., the fastening members 32, 35*b* and 35*c*.

Materials of the reinforcing members 36 depend on the material used for the girdle in accordance with the present invention, but not limited as long as the material withstands a load caused by a wearer, such as denim/jean, artificial leather, fabrics with strong stretchiness, and the like. It is favorable that a cloth is attached to a surface of the girdle facing the body of the wearer to guard the wearer's skin; for example, a cloth fabricated from soft and highly absorbent materials, such as cotton materials, urethane materials, and the like, is preferable to be attached to a backside surface of a stretching tape.

Next, the present invention will be explained with reference to FIG. 3 to FIG. 5 in view of a configuration of the girdle when disposed about a wearer.

Figure 3:
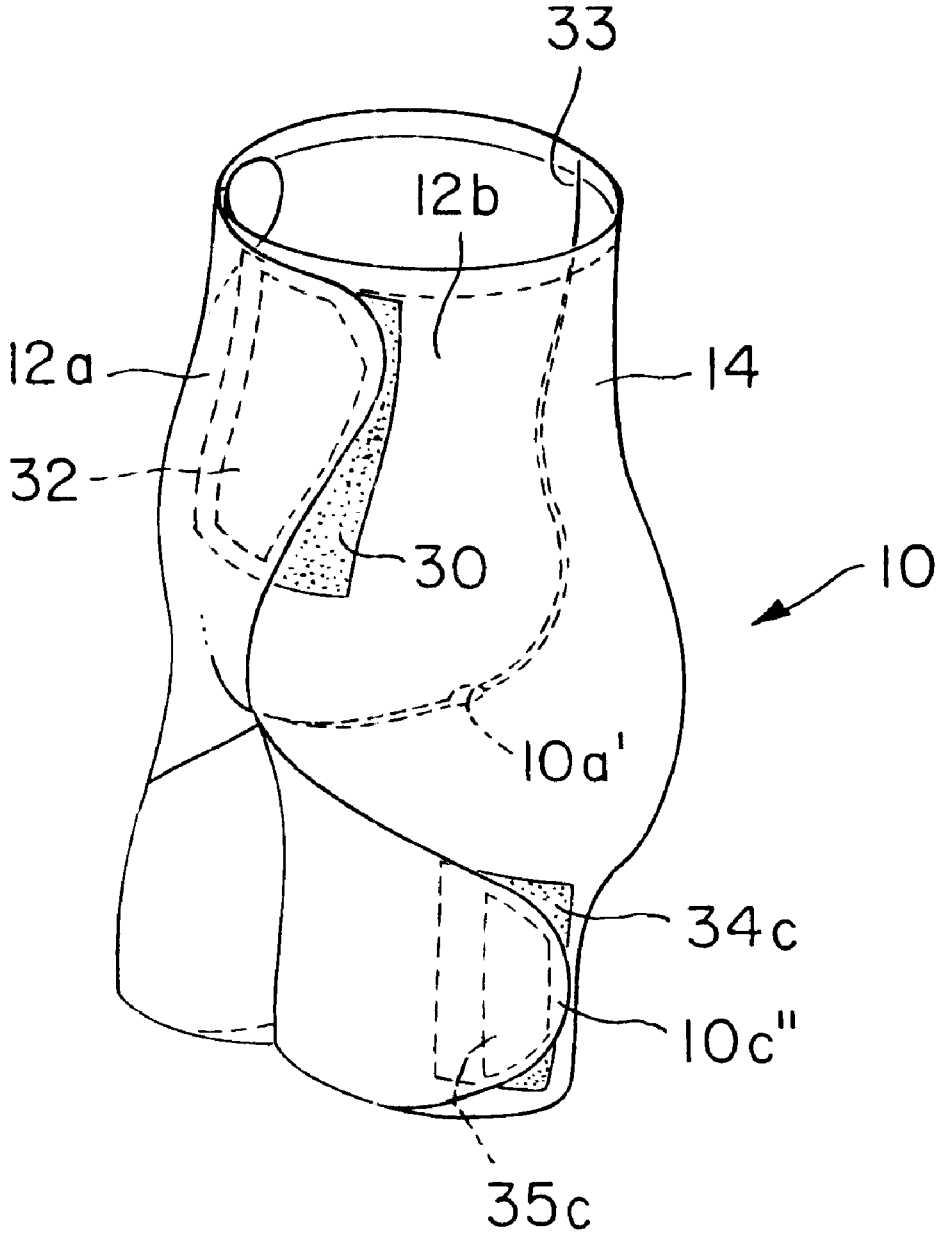
FIG. 3 is a perspective diagonal view of the girdle according to the first embodiment of the present invention viewed in a configuration it assumes when disposed about the wearer.
Figure 4:
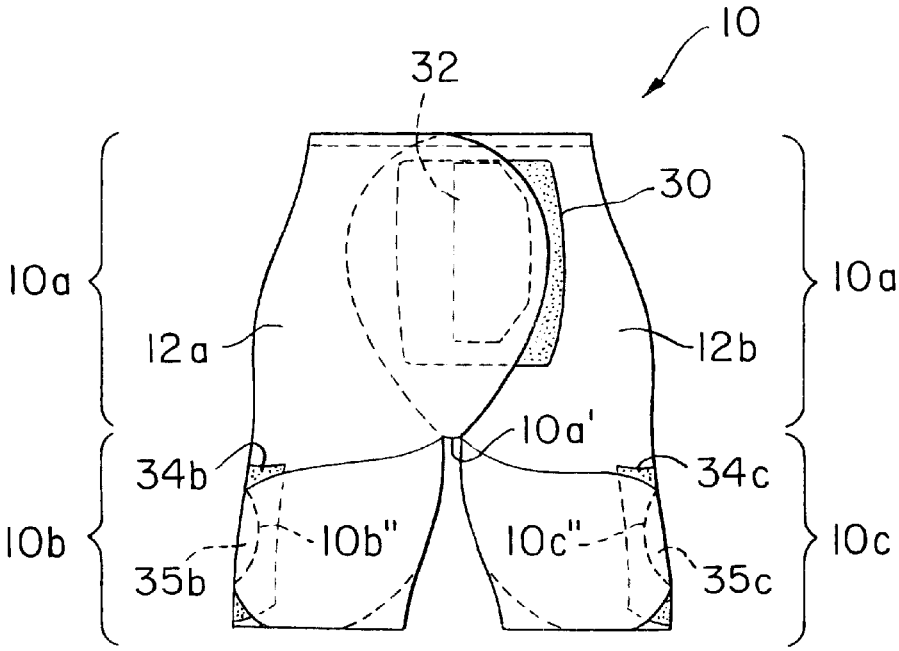
FIG. 4 is a perspective front view of the girdle according to the first embodiment of the present invention viewed in the configuration it assumes when disposed about the wearer.
Figure 5:
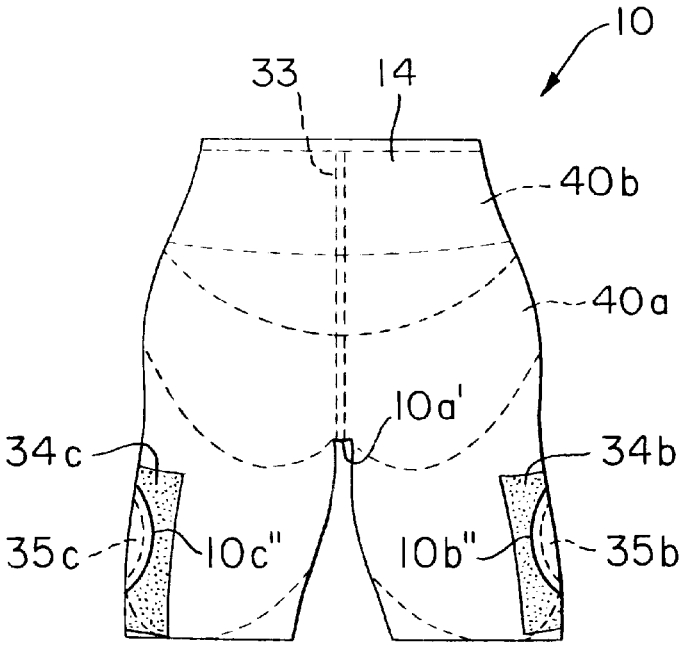
FIG. 5 is a perspective back view of the girdle according to the first embodiment of the present invention viewed in the configuration it assumes when disposed about the wearer.

FIG. 3 is a perspective diagonal view of the girdle 10 viewed in a configuration it assumes when disposed about a wearer, and FIG. 4 is a perspective front view of the girdle 10 viewed in the configuration it assumes when disposed about a wearer, and FIG. 5 is a perspective back view of the girdle 10 viewed in the configuration it assumes when disposed about a wearer.

As shown in FIGS. 3 and 4, the girdle 10 according to the present embodiment comprises the hips encircling region 10*a*, which encircles hips of the wearer by covering the hips from a back side and is fastened at a lower abdomen of the wearer with one end on top of another.

As shown in FIGS. 3 and 4, the hips encircling region 10*a* is fastened by the fastening member 30 and the fastening member 32, which can be adjusted to produce a wearer's preferred degree of tension in proportion to a dimension of an overlapping area of the fastening members.

The right leg encircling region 10*b* is fastened by winding firstly the front end portion 10*b*' of the right leg encircling region 10*b* around a right thigh part of the wearer from a front side towards an inside, winding secondly the back end portion 10*b*" of the right leg encircling region 10*b* around the right thigh part of the wearer from a back side and passing through the inside to the front side, and then placing the fastening member 35*b* on top of the fastening member 34*b* at an outside of the right thigh part of the wearer. The right leg encircling region 10*b* is fastened by the fastening member 34*b* and the fastening member 35*b*, which can be adjusted to produce the wearer's preferred degree of tension in proportion to a dimension of an overlapping area of the fastening members.

The left leg encircling region 10*c* is disposed on the wearer in the same way by which the right leg encircling region 10*b* is disposed.

The disposing order may be either the front side first or the leg encircling regions first.

Obviously, as shown in FIGS. 3, 4 and 5, the central part 10*a*' positioned at the central part of the lower edge of the hips encircling region 10*a* is pulled into an area between the legs of the wearer, and a slit of cloth on the haunch part of the wearer cannot be seen from the outside by pulling each of the leg encircling regions 10*b* and 10*c* from the inside of a corresponding thigh part of the wearer in a direction toward the front side of the body of the wearer, according to the girdle of the present embodiment. That is, an opening formed at the crotch part of the wearer is hidden from others' regular sight in a normal situation when the girdle is disposed about the wearer.

Also, by pulling each of the front end portions 10*b*' and 10*c*' of corresponding thigh parts from an inside thigh part of the wearer toward a back side of the body of the wearer, the end portions of the left and the right front sides 12*a* and 12*b* cover the lower abdomen of the wearer to turn in between thigh parts of the wearer. In this situation, the end portions of the left and the right front sides 12*a* and 12*b* cover the lower abdomen of the wearer by overlapping each other so that the lower abdomen of the wearer cannot been seen from the outside.

That is, the girdle 10 according to the present embodiment is characterized in that the end portions 10*b*', 10*b*", 10*c*' and 10*c*" of the leg encircling regions pull the opening, formed at the crotch region, into an area between legs of the wearer when the girdle is disposed about the wearer. Therefore, an opening part at the crotch of the wearer is hidden to provide a look which is not different from that of a regular undergarment insofar as appearance is concerned.

It is preferred that a position of the end portions of the front side 12*a* and 12*b* are symmetrical with respect to a central vertical line of an abdomen part of a wearer so that burdens to the body of the wearer produced by elasticity of material and compression of an opening/closing portion of the girdle according to the present invention are evenly loaded to left and right sides of the body of the wearer.

It is obvious by the above explanations that the girdle 10 according to the present embodiment covers hips and thigh parts of a wearer in their entirety, and a crotch part of the wearer is not exposed to others' regular sight in a normal situation. Also, the hips encircling region 10*a* and the right leg encircling region 10*b*, and the hips encircling region 10*a* and the left leg encircling region 10*c*, are formed continuously to form a single cloth. Therefore, when disposed about a wearer, the girdle 10 according to the present embodiment is not different from a regular undergarment insofar as appearance is concerned. However, that there is no crotch region results in preventing air-tightness and pressure at the crotch part of the wearer. Also, by unfastening the fastening members 34*b*, 35*b*, 34*c* and 35*c* of the leg encircling regions 10*b* and 10*c*, excretion is possible without taking off the girdle 10.

Moreover, in accordance with the girdle 10, tensions to the lower abdomen and left and right thigh parts can be freely controlled by adjusting dimensions of overlapping areas of the right front side 12*a* and the left front side 12*b*, the front end portion 10*b*' and the back end portion 10*b*" of the right leg encircling region, and the front end portion 10*c*' and the back end portion 10*c*" of the left leg encircling region, and thus a wearer's preferred figure-correcting effect is achieved.

The front sides 12*a* and 12*b* are adjusted to fully bring out their figure-correcting functions especially for a purpose of correcting an abdomen part and a waist region of a wearer. The leg encircling regions 10*b* and 10*c* are adjusted to fully bring out their figure-correcting functions especially for a purpose of correcting thigh parts of the wearer. In addition, the correction cloths 40*a*, 40*b*, and the haunch lifting tape 33, are adjusted to fully bring out their figure-correcting functions especially for a purpose of correcting a haunch part of the wearer.

Additionally, the girdle according to the present invention may have a wider shape so that the waist region is covered up to a trunk of the wearer. For instance, the girdle can have a shape extended to an under-bust of the wearer. In the same way as conventional girdles, the waist region of the girdle according to the present invention is backed with a stretch fabric for reinforcement.

An overlapping area of the front sides 12*a* and 12*b* is not necessarily limited and can be widened as long as movements of a wearer are not disturbed, since a full figure-correcting function can be brought out due to a double correcting effect achieved by an overlapping part on an abdomen part of the wearer. Likewise, an overlapping area of the end portions 10*b*', 10*b*", 10*c*' and 10*c*" of the leg encircling regions are not necessarily limited just like the front sides 12*a* and 12*b*, and can be widened as long as movements of the wearer are not disturbed. Shapes of the front sides 12*a*, 12*b*, and the end portions 10*b*', 10*b*", 10*c*' and 10*c*" of the leg encircling regions are not necessarily limited as long as a full figure-correcting function can be brought out by the elasticity of a material used for the girdle according to the present invention.

Materials used for the girdle according to the present invention, with the girdle being constructed by the front side, the back side and the leg encircling regions, include fabrics that are elastic in one horizontal direction from side to side of the girdle, or two directions, or rather multi-directions. Also, non-elastic fabrics can be partially used in accordance with certain purposes. For example, the materials can include a satin-type power net, a satin-type tricot, a raschel textile containing elastic fabric, a power net containing elastic fabric, a tricot containing elastic fabric, and the like.

In a case that a French pile, or the like, which functions as a female member of a surface fastener is used, the girdle can be applied to a variety of body figures since an end portion that is overlapped and fastened can be attached to and detached from any place on the girdle body. In this case, a wearer can wear the girdle without discomfort caused by a partially different material thereon because a female member of a surface fastener is not necessary.

Attaching reinforcing members 36 can prevent curling up of end portions which are overlapped and fastened, and can also prevent partial enlargement of the end portions by being held and pulled by a wearer upon disposing the girdle thereabout.

Figure 6:
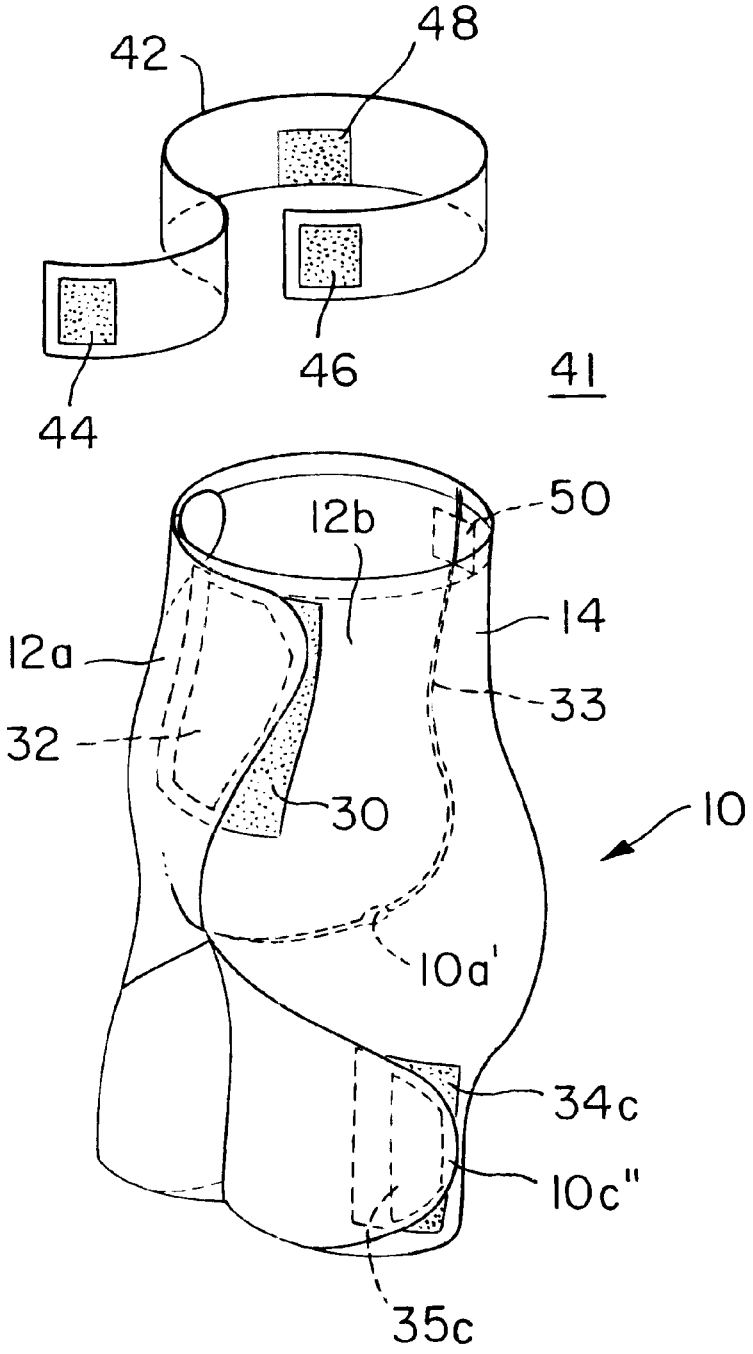
FIG. 6 is a perspective diagonal view of the girdle according to a second embodiment of the present invention viewed in a configuration it assumes when disposed about a wearer.
Figure 7:
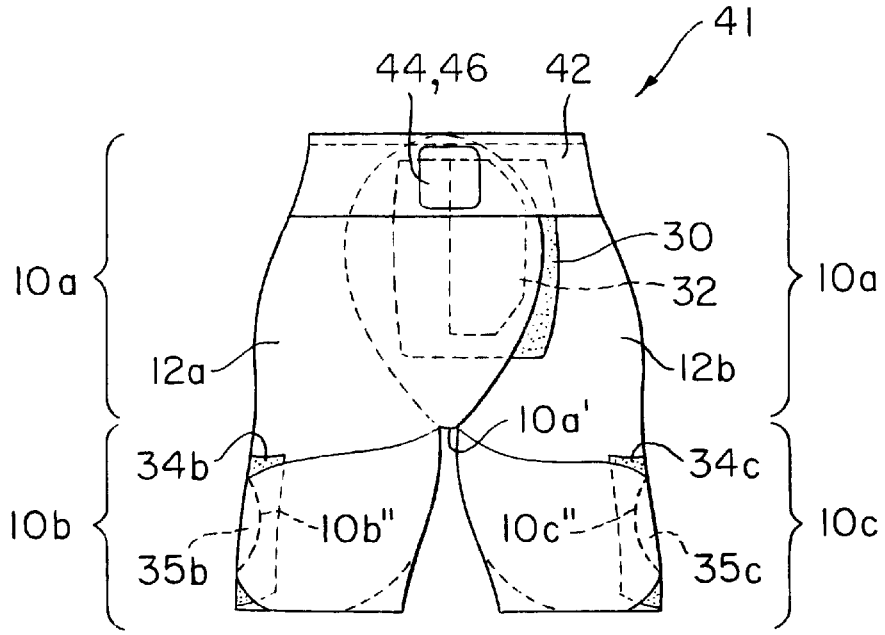
FIG. 7 is a perspective front view of the girdle according to the second embodiment of the present invention viewed in the configuration it assumes when disposed about the wearer.
Figure 8:
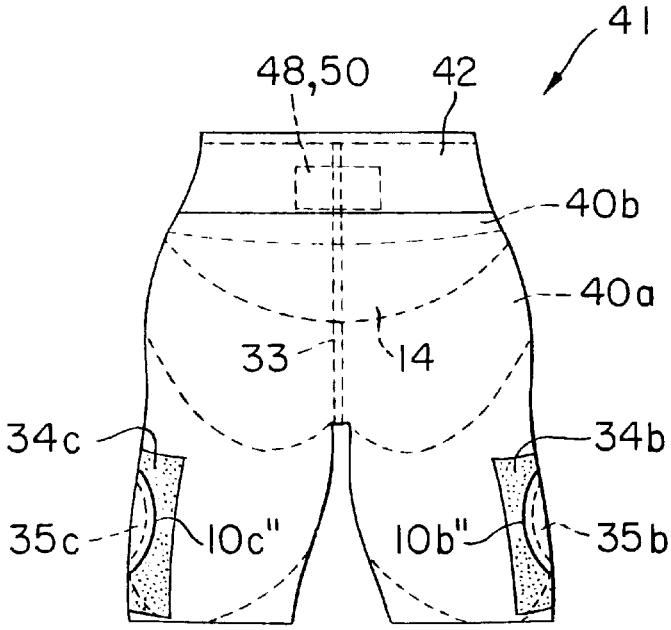
FIG. 8 is a perspective back view of the girdle according to the second embodiment of the present invention viewed in the configuration it assumes when disposed about the wearer.

A second embodiment according to the present invention will be explained with reference to FIGS. 6, 7 and 8.

In addition to the girdle 10 according to the first embodiment, a girdle 41 according to the second embodiment further comprises a strip 42 which can be attached and detached. Fastening members 44 and 46 are disposed on both end portions of the strip 42 as shown in FIG. 6.

The strip 42 can further correct an entire waist region of a wearer corresponding to a wearer's desired level, in addition to performing a figure-correcting effect of a girdle, by bringing the strip 42 into an overlapping relationship partially or entirely with a waist region of the girdle according to the first embodiment. It is preferable that the strip 42 can freely be attached to and detached from the front sides 12*a*, 12*b* and/or the back side 14 of the hips encircling region 10*a*. For example, as shown in FIG. 6, a fastening member 50 can be disposed at the waist region of the back side 14 of the girdle while a fastening member 48 is disposed at a corresponding part of the strip 42. By disposing the fastening members 48 and 50, the strip 42 is prevented from sliding off the girdle 10 by movements of a wearer.

It is preferred that the fastening member 48 is in the form of a surface fastener. For example, as shown in FIG. 6, a female member of a surface fastener is disposed at a central part of the waist region of the back side 14 of the girdle 10, and a male member of a surface fastener as the fastening member 48 is disposed at a corresponding part of the strip 42. Also, at a part of the strip 42 where both its ends overlap each other, a female member of a surface fastener as the fastening member 46 is disposed on an outside surface of a lower end portion, and a male member of a surface fastener as the fastening member 44 is disposed on an inside surface of an upper end portion. The end portions of the strip 42 are secured together by these surface fasteners so that the waist region of a wearer can be corrected. The strip 42 can be prepared by forming a stretch tape with a preferred width, with the stretch tape being made of a longitudinally extending elastic textile, i.e., a textile containing an elastic fiber exemplified as rubber, polyurethane yarn, and the like. The width of the strip is not limited as long as an abdominal region of a wearer is covered. The width simply needs to match a width of a part that a wearer desires to correct. The length of the strip 42 is not limited as long as the strip can be applied to a wider range of waist sizes, considering an area where the fastening members overlap each other.

Next, a girdle 52 according to a third embodiment of the present invention will be explained.

Figure 9:
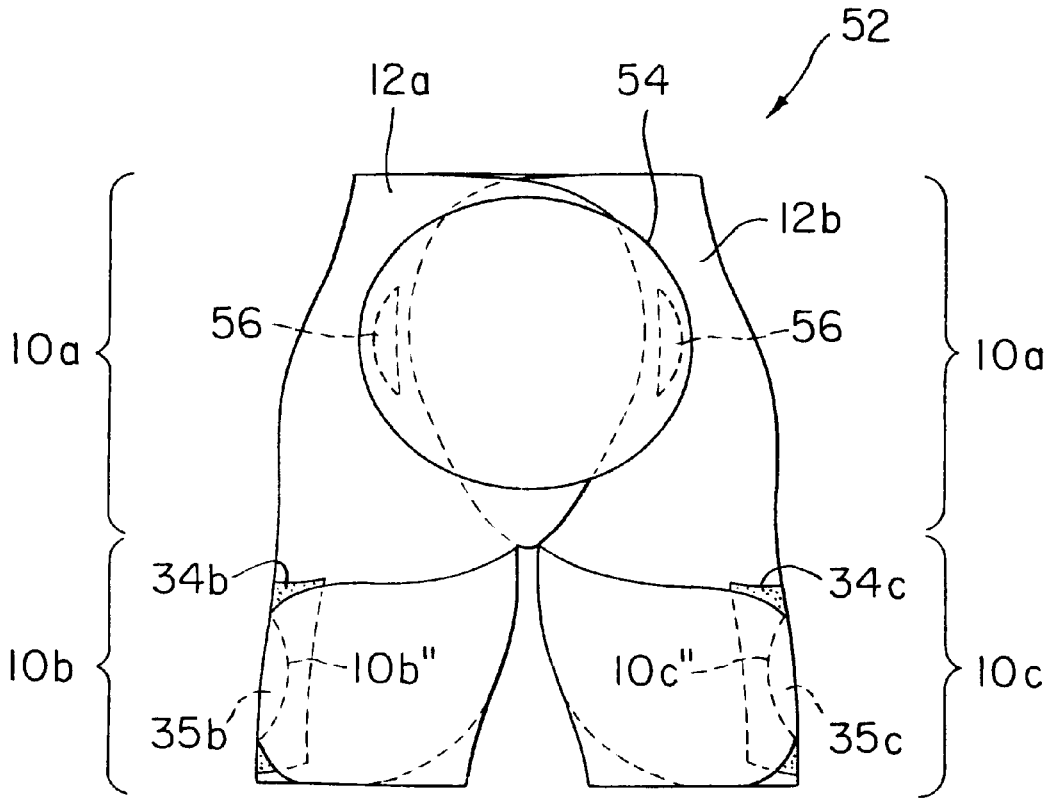
FIG. 9 is a perspective front view of the girdle according to a third embodiment of the present invention viewed in a configuration it assumes when disposed about a wearer.

As shown in FIG. 9, the girdle 52 according to the present embodiment has an abdominal region pressing cloth 54 that is further added to the girdle 10 of the first embodiment. The abdominal region pressing cloth 54 is attachable to and detachable from the girdle, and can be disposed in order to further correct an abdominal region after the girdle is put on.

The abdominal region pressing cloth 54 can be made of either a stretchy cloth or non-elastic cloth with strength. An attaching/detaching function is provided by fastening members 56 disposed on the abdominal region pressing cloth 54, wherein the fastening members can be in the form of surface fasteners. In this case, female members of the surface fasteners are disposed respectively on the front sides 12*a* and 12*b* so that the fastening members 56 disposed on the abdominal region pressing cloth 54 can be engaged. Also, it is preferable that the girdle body is made of a material which functions as a female member of a surface fastener, e.g., a French pile, and the like, and in this case, female members of surface fasters are not necessary.

Figure 10:
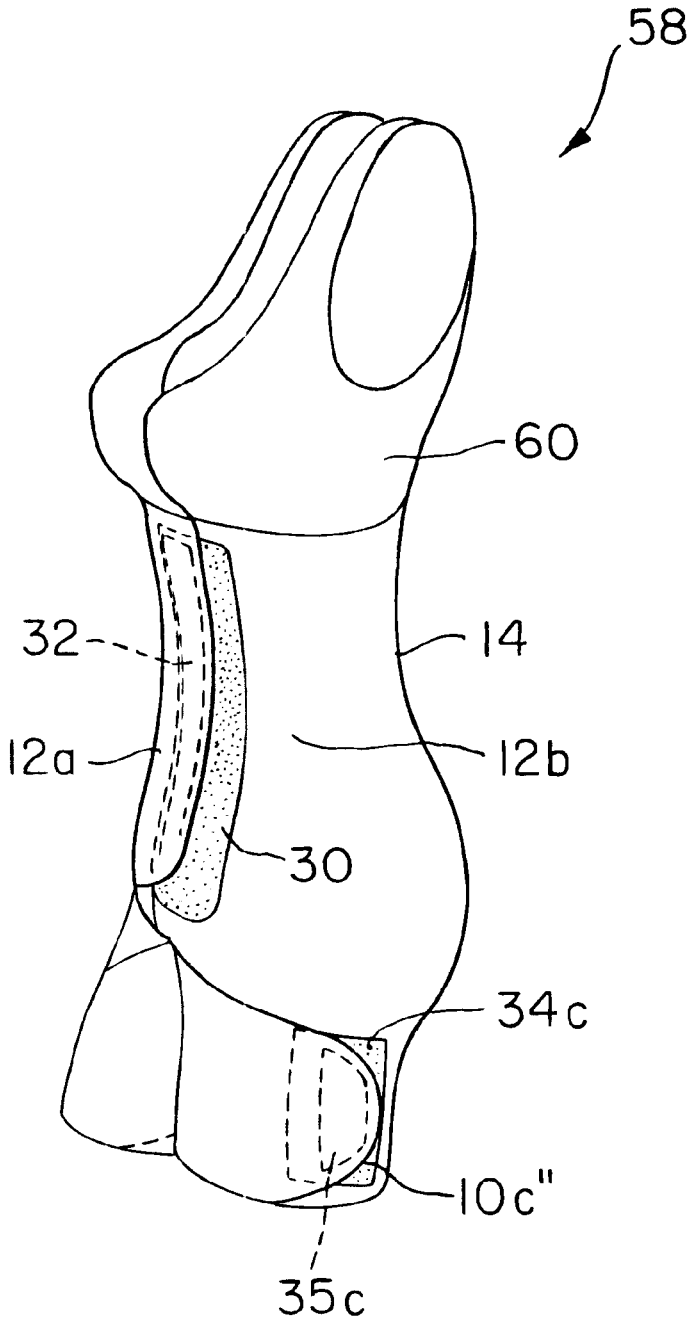
FIG. 10 is a perspective diagonal view of the girdle according to a fourth embodiment of the present invention viewed in a configuration it assumes when disposed about a wearer.

As a fourth embodiment of the present invention, a girdle and a brassiere can be formed of one piece to provide an all-in-one style garment (body suit). For example, as shown in FIG. 10, a girdle 58 according to the present embodiment is extended along a trunk of a wearer and is integral with a brassier part 60. An opening/closing portion of a trunk part is fastened with surface fasters, and the like, and the brassiere part can be secured by hooks, snaps, and the like which are adjustable in certain intervals.

The foregoing descriptions are about embodiments of the girdle according to the present invention, but the present invention is not limited to these embodiments. Still other variety of improvements, modifications and corrections can be made by a person skilled in the art without departing from a purpose of the present invention.

The above-mentioned "leg encircling region" can be extended as necessary to form a part covering an entire leg. A case of "thigh encircling region" instead of "leg encircling region" is also included in the scope of the present invention.

As described above, the girdle according to the present invention can be disposed about a wearer without legs of the wearer passing through tubular parts of a girdle since the girdle has no crotch region, and by opening fastening members disposed respectively on the hips encircling region and the leg encircling regions, the girdle can encircle a body of the wearer, due to its novel form. Also, the wearer feels comfortable while wearing the girdle without experiencing sweatiness, or the like because a crotch region is not formed. Since an opening of the crotch region is hidden from others' regular sight in a normal situation after the girdle is disposed on the wearer, an appearance that is almost like a normal undergarment can be provided.

Moreover, a size of the girdle can be freely adjusted by fastening members, which are adjustable and detachable, disposed on the hips encircling region and the leg encircling regions, respectively. Therefore, the girdle can be adjusted to fit a figure of a wearer even if a size of the figure changes, and in addition, the girdle according to the present invention can be worn by both men and women, although men and women have different builds and figures because size of every part of the girdle can be freely adjusted.

Furthermore, the girdle according to the present invention can independently correct each body part of a wearer by disposing a cloth, constructed from a textile containing an elastic fabric, on a prescribed region of the front sides, back side and leg encircling regions, respectively.

Besides, the girdle according to the present invention can further comprise a strip with fastening members disposed on both its end parts so that an entire abdominal region can be effectively corrected.

Also, the girdle according to the present invention can be easily disposed about a wearer regardless of a style of clothes worn over the girdle.

Moreover, although the foregoing descriptions aim at figure-correcting functions, the girdle according to the present invention can effectively decrease and prevent muscular exhaustion because a muscle supporting function is also effectively brought out by disposing a textile containing an elastic fiber along fibers of the muscle.

Furthermore, the girdle can effectively prevent and ease back pains. An effect of preventing and easing back pains is achieved by disposing a textile containing an elastic fiber having a support function, on the back side and/or on a part of the hips encircling region on a strip of the girdle according to the present invention, or by further combining a board, made of a resin as a supporting member, with the textile.

What is claimed is:

1. A girdle comprising:

a single elastic member having (i) a first portion and a second portion that are releasably connectable to each other such that when said first portion is connected to said second portion front sides are defined by said first portion and said second portion, (ii) a third portion and a fourth portion that are releasably connectable to each other such that when said third portion is connected to said fourth portion a first leg encircling region is defined by said third portion and said fourth portion, (iii) a fifth portion and a sixth portion that are releasably connectable to each other such that when said fifth portion is connected to said sixth portion a second leg encircling region is defined by said fifth portion and said sixth portion, and (iv) a seventh portion that defines a back side when said first portion is connected to said second portion, wherein when said elastic member is worn by a wearer by connecting said first portion to said second portion, by connecting said third portion to said fourth portion, and by connecting said fifth portion to said sixth portion, said front sides are adjacent a front abdominal region of the wearer, said back side is adjacent a back region of the wearer, said first leg encircling region encircles one leg of the wearer, said second leg encircling region encircles another leg of the wearer, and a crotch region is not formed but an opening at a crotch of the wearer is hidden from view by said elastic member.

2. The girdle according to claim 1, wherein said first portion and said second portion are releasably connectable to each other via first and second fastening members that engage each other when said first portion and said second portion overlap one another, said third portion and said fourth portion are releasably connectable to each other via third and fourth fastening members that engage each other when said third portion and said fourth portion overlap one another, and said fifth portion and said sixth portion are releasably connectable to each other via fifth and sixth fastening members that engage each other when said fifth portion and said sixth portion overlap one another.

3. The girdle according to claim 2, wherein said first, second, third, fourth, fifth and sixth fastening members comprise surface fasteners.

4. The girdle according to claim 1, further comprising:

a correction member that produces a compressing force when a tension is applied thereto, said correction member being at each of (i) said first and second portions, (ii) at least one of said third and fourth portions, (iii) at least one of said fifth and sixth portions, and (iv) said seventh portion.

5. The girdle according to claim 1, further comprising:

a strip having fastening members thereon, said fastening members being engageable with each other.

6. The girdle according to claim 5, wherein said strip has an additional fastener member thereon which is connectable to said seventh portion at a position that corresponds to a waist region of the wearer when said elastic member is worn by the wearer.

7. The girdle according to claim 1, further comprising:

a pressing member that is releasably connectable to said first portion and said second portion such that when said elastic member is worn by the wearer, and said pressing member is connected to said first portion and said second portion, said pressing member is positioned at an abdominal region of the wearer.

8. The girdle according to claim 1, wherein said third portion is contiguous with said first portion, said fourth portion is not contiguous with said first portion and extends from said third portion, said fifth portion is contiguous with said second portion, said sixth portion is not contiguous with said second portion and extends from said fifth portion, and a notch is located at a juncture of said first portion and said second portion in the vicinity where said fourth portion extends from said third portion and said sixth portion extends from said fifth portion, with said notch corresponding to the opening of the crotch of the wearer when said elastic member is worn by the wearer.

9. The girdle according to claim 8, wherein the opening at the crotch of the wearer is hidden from view, when said elastic member is worn by the wearer, by said notch being pulled between the one leg and the another leg of the wearer in response to said third portion being connected to said fourth portion and said fifth portion being connected to said sixth portion.

10. A girdle comprising:

a single elastic member having (i) a first portion and a second portion that are adjustably and releasably connectable to each other such that when said first portion is connected to said second portion a hips encircling region is defined by said first portion and said second portion, (ii) a third portion and a fourth portion that are adjustably and releasably connectable to each other such that when said third portion is connected to said fourth portion a first leg encircling region is defined by said third portion and said fourth portion, and (iii) a fifth portion and a sixth portion that are adjustably and releasably connectable to each other such that when said fifth portion is connected to said sixth portion a second leg encircling region is defined by said fifth portion and said sixth portion, wherein when said elastic member is worn by a wearer by connecting said first portion to said second portion, by connecting said third portion to said fourth portion, and by connecting said fifth portion to said sixth portion, said hips encircling region encircles hips of the wearer, said first leg encircling region encircles one leg of the wearer, and said second leg encircling region encircles another leg of the wearer.

11. The girdle according to claim 10, wherein said first portion and said second portion are adjustably and releasably connectable to each other via first and second fastening members that engage each other when said first portion and said second portion overlap one another, with said first portion and said second portion overlapping one another at an abdominal region of the wearer when said elastic member is worn by the wearer, said third portion includes a first projected end portion having a third fastening member, with said third portion and said fourth portion being adjustably and releasably connectable to each other via said third fastening member engaging said fourth portion when said fourth portion is positioned under said first projected end portion, and said fifth portion includes a second projected end portion having a fourth fastening member, with said fifth portion and said sixth portion being adjustably and releasably connectable to each other via said fourth fastening member engaging said sixth portion when said sixth portion is positioned under said second projected end portion.

12. The girdle according to claim 11, wherein said first fastening member comprises a male surface fastener on said first portion, said second fastening member comprises one of (i) a female surface fastener disposed on said second portion, and (ii) material of said second portion, said third fastening member comprises a male surface fastener on said first projected end portion which is connectable to said fourth portion via a fifth fastening member, said fifth fastening member comprising one of (i) a female surface fastener disposed on said fourth portion, and (ii) material of said fourth portion, and said fourth fastening member comprises a male surface fastener on said second projected end portion which is connectable to said sixth portion via a sixth fastening member, said sixth fastening member comprising one of (i) a female surface fastener disposed on said sixth portion, and (ii) material of said sixth portion.

13. The girdle according to claim 11, further comprising:

a correction member that produces a compressing force when a tension is applied thereto, said correction member being at at least one of (i) said first and second portions such that when said elastic member is worn by the wearer said correction member is at a front side or a back side of said hips encircling region, (ii) at least one of said third and fourth portions such that when said elastic member is worn by the wearer said correction member is at said first leg encircling region, and (iii) at least one of said fifth and sixth portions such that when said elastic member is worn by the wearer said correction member is at said second leg encircling region.

14. The girdle according to claim 11, further comprising:

a strip having fastening members thereon, said fastening members being engageable with each other.

15. The girdle according to claim 11, further comprising:

a pressing member that is releasably connectable to said first portion and said second portion such that when said elastic member is worn by the wearer said pressing member is positioned at the abdominal region of the wearer.

16. The girdle according to claim 11, wherein said elastic member defines a brassiere part, with said brassiere part surrounding a trunk of the wearer when said elastic member is worn by the wearer.

17. The girdle according to claim 11, wherein said elastic member is constructed and arranged such that when said elastic member is worn by the wearer an opening formed at a crotch of the wearer is hidden from view by said elastic member.

18. The girdle according to claim 17, wherein said third portion is contiguous with said first portion, said fourth portion is not contiguous with said first portion and extends from said third portion, said fifth portion is contiguous with said second portion, said sixth portion is not contiguous with said second portion and extends from said fifth portion, and a notch is located at a juncture of said first portion and said second portion in the vicinity where said fourth portion extends from said third portion and said sixth portion extends from said fifth portion, with said notch corresponding to the opening of the crotch of the wearer when said elastic member is worn by the wearer.

19. The girdle according to claim 18, wherein the opening at the crotch of the wearer is hidden from view, when said elastic member is worn by the wearer, by said notch being pulled between the one leg and the another leg of the wearer in response to said third portion being connected to said fourth portion and said fifth portion being connected to said sixth portion.

* * * * *